US010406813B2

(12) United States Patent
Takei

(10) Patent No.: US 10,406,813 B2
(45) Date of Patent: Sep. 10, 2019

(54) LIQUID EJECTION HEAD

(71) Applicant: CANON KABUSHIKI KAISHA, Tokyo (JP)

(72) Inventor: Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/987,678

(22) Filed: May 23, 2018

(65) Prior Publication Data

US 2018/0339511 A1 Nov. 29, 2018

(30) Foreign Application Priority Data

May 26, 2017 (JP) ..... 2017-104161

(51) Int. Cl.
*B41J 2/14* (2006.01)
*B41J 2/16* (2006.01)

(52) U.S. Cl.
CPC ..... *B41J 2/1433* (2013.01); *B41J 2/14016* (2013.01); *B41J 2/14201* (2013.01); *B41J 2/1601* (2013.01); *B41J 2/162* (2013.01); *B41J 2/1603* (2013.01); *B41J 2/1626* (2013.01); *B41J 2/1631* (2013.01); *B41J 2/1639* (2013.01); *B41J 2002/14169* (2013.01); *B41J 2002/14475* (2013.01)

(58) Field of Classification Search
CPC combination set(s) only.
See application file for complete search history.

(56) References Cited

U.S. PATENT DOCUMENTS 5,451,993 A * 9/1995 Takahashi ..... B41J 2/1404 347/47
6,123,413 A * 9/2000 Agarwal ..... B41J 2/14 239/601
6,130,688 A * 10/2000 Agarwal ..... B41J 2/14016 347/47
6,331,055 B1 * 12/2001 Miller ..... B41J 2/1404 347/92
6,371,596 B1 * 4/2002 Maze ..... B41J 2/14016 347/47
6,450,619 B1 * 9/2002 Anagnostopoulos ..... B41J 2/02 347/59
6,880,916 B2 * 4/2005 Kim ..... B41J 2/1603 347/47

(Continued)

FOREIGN PATENT DOCUMENTS

JP 2013-914 A 1/2013

*Primary Examiner* — Juanita D Jackson
(74) *Attorney, Agent, or Firm* — Canon U.S.A., Inc. I.P. Division

(57) ABSTRACT

An ejection port includes a first ejection port that is an opening portion formed on an outer surface side of a recessed portion formed in an outer surface of a nozzle plate, a second ejection port positioned on a bottom surface side of the recessed portion, the second ejection port including an opening portion that is smaller than the first ejection port, and a plurality of protrusions that extend from an outer edge portion of the first ejection port towards a center portion of the second ejection port through the second ejection port, in which a distance between tip portions of the plurality of protrusions and the substrate is larger than a distance between an outer edge portion of the second ejection port and the substrate.

15 Claims, 8 Drawing Sheets

(56) References Cited

U.S. PATENT DOCUMENTS

| | | | | |
|---|---|---|---|---|
| 6,926,392 | B2 * | 8/2005 | Sasaki | A61M 15/0065 347/65 |
| 6,938,986 | B2 * | 9/2005 | Macler | B41J 2/1433 347/45 |
| 6,938,988 | B2 * | 9/2005 | Clark | B41J 2/14016 347/47 |
| 6,988,786 | B2 * | 1/2006 | Kaneko | B41J 2/1404 347/44 |
| 7,399,060 | B2 * | 7/2008 | Tsuchii | B41J 2/1404 347/44 |
| 7,506,962 | B2 * | 3/2009 | Murakami | B41J 2/1404 347/44 |
| 7,887,159 | B2 * | 2/2011 | Takei | B41J 2/1433 347/20 |
| 8,282,194 | B2 * | 10/2012 | Ozawa | B41J 2/14274 347/47 |
| 2005/0110835 | A1 * | 5/2005 | Ito | B41J 2/1433 347/47 |
| 2005/0264612 | A1 * | 12/2005 | Silverbrook | B41J 2/14314 347/56 |
| 2008/0291245 | A1 * | 11/2008 | Takei | B41J 2/1404 347/47 |
| 2010/0128088 | A1 * | 5/2010 | Kang | B41J 2/1433 347/47 |
| 2013/0266901 | A1 * | 10/2013 | Ikegame | G03F 7/20 430/320 |
| 2014/0125735 | A1 * | 5/2014 | Takei | B41J 2/1404 347/44 |
| 2015/0001321 | A1 * | 1/2015 | Ge | B41J 2/1404 239/590 |
| 2017/0282555 | A1 * | 10/2017 | De Meutter | B41J 2/14 |
| 2018/0086080 | A1 * | 3/2018 | Horiuchi | B41J 2/1404 |

* cited by examiner

LIQUID EJECTION HEAD

BACKGROUND OF THE INVENTION

Field of the Invention

The present disclosure relates to a liquid ejection head that performs recording by ejecting a liquid, such as ink, onto various mediums.

Description of the Related Art

An ink jet printing method is known as a typical method used to eject a liquid, such as ink. The droplets are becoming small and the number of nozzles is increasing in liquid ejection heads of recent years, and the effect of the discharge liquid droplets, which had not been a problem in conventional printing operations, is becoming large. Specifically, such a problem includes a degradation in the image due to the ink droplet applied to the recording medium becoming separated into a plurality of droplets (a main droplet and satellite droplets), and transfer of dirt of the printing apparatus on the recording medium, such as ink droplets (hereinafter, referred to as mist) that is floating in the air before reaching the recoding medium due to lack of speed.

Furthermore, in a case in which printing is performed with a liquid ejection head having a nozzle that has not printed for a certain period of time, the ink evaporates inside the nozzle, and viscosity of the ink increases. With the above, there are cases in which the ink droplet is not ejected, or the ink not being ejected straight is applied on an unintended portion of the printing medium. Regarding the above effects happening at the start of the ejection, an election failure occurs more when a resistance of the election port portion on the front side of an energy generating element increases.

As a measure for the above, for example, in Japanese Patent Laid-Open No. 2013-914, in a tubular structure that connects an ejection port and a liquid chamber to each other, the tubular structure is formed in a tapered shape to reduce the resistance at the front so that election stability at the start of ejection is improved. In particular, in a method that forms a taper by providing a depressed portion in the surface when forming the ejection port, a large taper angle can be obtained without compromising the size accuracy of the ejection port; accordingly, the above method is effective in improving the ejection efficiency and improving the ejection stability at the start of ejection.

With the method in Japanese Patent Laid-Open No. 2013-914 described above, the resistance of the ejection port portion on the front of the energy generating element is reduced, and the energy supplied from the energy generating element is efficiently converted into the ejection operation. However, accompanying the above, the ejecting speed of the ejection liquid increases. When the ejecting speed of a liquid increases, the liquid column portion becomes stretched long during the ejection operation at the stage when the main droplet portion and the liquid column portion are formed, making a lot of satellite droplets and mist to be easily generated by the liquid column portion becoming divided.

SUMMARY OF THE INVENTION

The present disclosure provides a liquid ejection head that is capable of achieving both reduction in the resistance of the ejection port portion and suppression of generation of satellite droplets.

In order to overcome the issue described above, an aspect of the present disclosure is a liquid ejection head including a substrate provided with an element that generates energy used to eject a liquid, and a nozzle plate including an ejection port that ejects the liquid. The ejection port includes a first ejection port that is an opening portion formed on an outer surface side of a recessed portion formed in an outer surface of the nozzle plate, a second ejection port positioned on a bottom surface side of the recessed portion, the second ejection port including an opening portion that is smaller than the first ejection port, and a plurality of protrusions that extend from an outer edge portion of the first ejection port towards a center portion of the second ejection port through the second ejection port. A distance between tip portions of the plurality of protrusions and the substrate is larger than a distance between an outer edge portion of the second ejection port and the substrate.

Furthermore, an aspect of the present disclosure is a liquid ejection head including a substrate provided with an element that generates energy used to eject a liquid, and a nozzle plate including an ejection port that ejects the liquid. The ejection port includes a first ejection port that is an opening portion formed on an outer surface side of a recessed portion formed in an outer surface of the nozzle plate, a second ejection port positioned on a bottom surface side of the recessed portion, the second ejection port including an opening portion that is smaller than the first ejection port, and a plurality of protrusions that extend from an outer edge portion of the first ejection port towards a center portion of the second election port through the second ejection port. The plurality of protrusions extend along the outer surface of the nozzle plate.

Furthermore, an aspect of the present disclosure is a liquid ejection head including a substrate provided with an element that generates energy used to eject a liquid, and a nozzle plate including an ejection port that ejects the liquid. The ejection port includes a first ejection port that is an opening portion formed on an outer surface side of a recessed portion formed in an outer surface of the nozzle plate, a second ejection port positioned on a bottom surface side of the recessed portion, the second ejection port including an opening portion that is smaller than the first ejection port, and a plurality of protrusions that extend from an outer edge portion of the first ejection port towards a center portion of the second ejection port through the second ejection port. In a state in which the liquid is filled in the liquid ejection head, a meniscus of the liquid is formed on an outer edge portion of the second ejection port, in which the meniscus at tip portions of the protrusions protrudes, with respect to the outer edge portion of the second ejection port, in an ejection direction in which the liquid is ejected.

Further features of the present disclosure will become apparent from the following description of exemplary embodiments with reference to the attached drawings.

DESCRIPTION OF THE EMBODIMENTS

Figure 1:
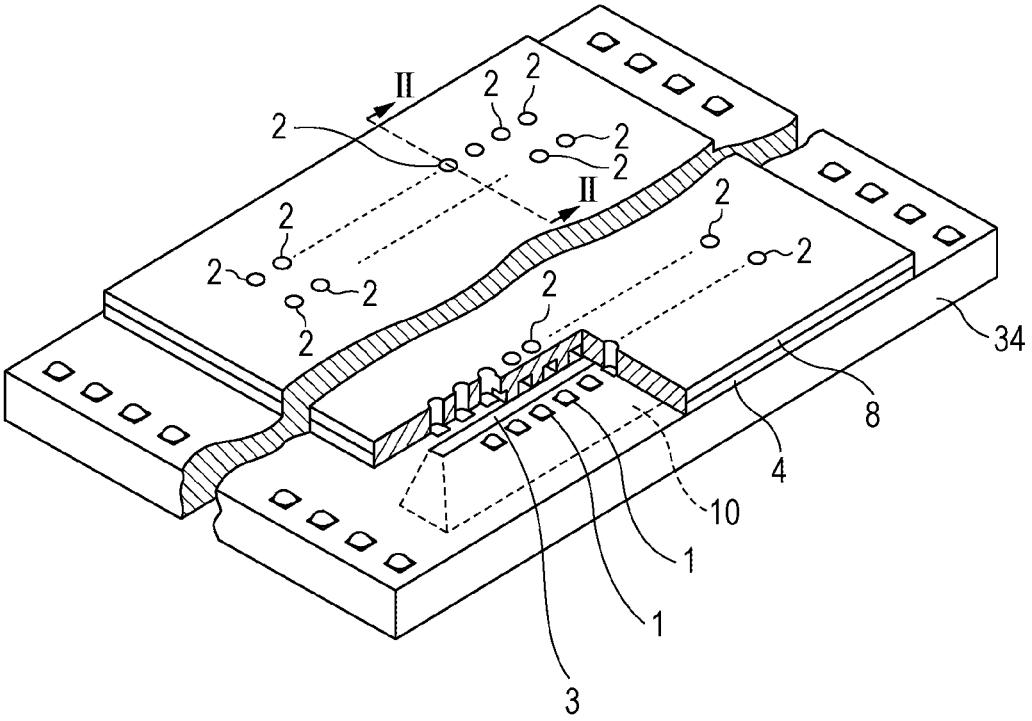
FIG. 1 is a perspective view of a liquid ejection head according to a first exemplary embodiment.
Figure 2:
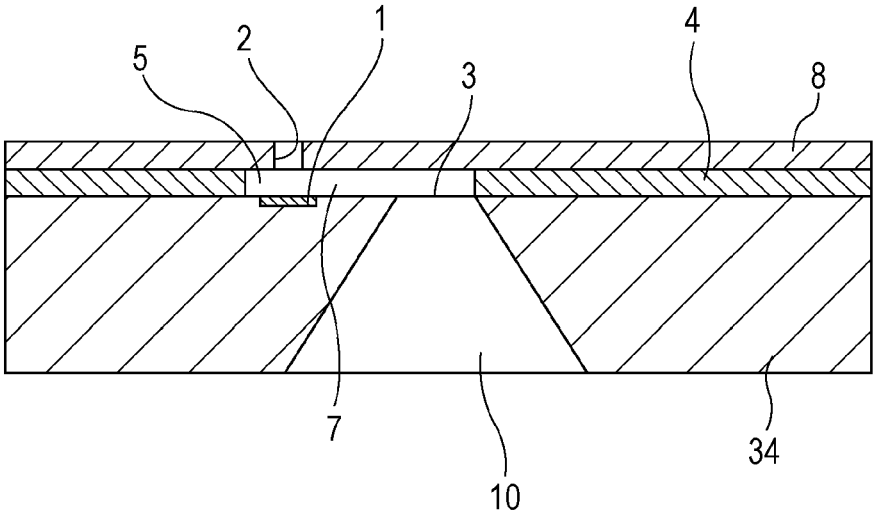
FIG. 2 is a cross-sectional view of the liquid ejection head taken along line II-II in FIG. 1.

A configuration of an ink jet liquid ejection head of the present exemplary embodiment will be described with reference to the drawings. FIG. 1 is a perspective view of the liquid ejection head of the present exemplary embodiment, and FIG. 2 is a section of the liquid ejection head illustrated in FIG. 1 taken along line II-II. A flow path constitution portion 4 and a nozzle plate 8 are provided on a substrate 34. A liquid supplied to the liquid ejection head is supplied to bubble forming chambers 5, which are pressure chambers, through ink supply ports 3 and liquid flow paths 7. In the present exemplary embodiment, electrothermal transducer elements serving as elements generating energy used to eject the liquid are used. Not limited to the above, the present disclosure may be applied also to a piezoelectric liquid ejection head that uses a piezoelectric element.

As illustrated in FIG. 1, energy generating elements functioning to eject ink, and the ink supply ports 3 each having a long and narrow rectangular shape are formed in a first surface of the substrate 34. The ink supply ports 3 are long groove-shaped through holes formed in the surface of the substrate 34 and correspond to openings to the ink supply chambers 10. The ink supply chambers 10 are provided as grooves in a second surface on the opposite side of the surface of the substrate 34 in which the electrothermal transducer elements 1 are formed, and are connected to ejection portions through the ink supply ports 3.

A line of electrothermal transducer elements 1 is arranged along each of the two sides of the ink supply ports 3 in the longitudinal direction so that the intervals, or pitches, of the electrothermal transducer elements 1 are 600 dpi. Moreover, the flow path constitution portion 4 is provided on the first surface of the substrate 34, and the nozzle plate 8 is adhered on the flow path constitution portion 4. Ejection ports 2 are provided in an outer surface of the nozzle plate 8 so as to correspond to the electrothermal transducer elements 1. The substrate 34 functions as a portion of the flow path constituting portion 4 and the material thereof is not limited to any material and may be any material that is capable of functioning as a supporting member of the energy generating members, and the material layers described later that form the ejection ports 2 and the flow paths. In the present exemplary embodiment, a silicon substrate is used as the substrate 34.

As illustrated in FIG. 2, the liquid flow paths 7 that guide the ink from the ink supply ports 3 to the bubble forming chambers 5 above the electrothermal transducer elements 1 are formed. Furthermore, the ejection ports 2 that are openings that communicate the bubble forming chambers 5 to the outside are formed in the nozzle plate 8. The ink droplets are ejected from the ejection ports 2. Note that in the present exemplary embodiment, while the nozzle plate 8 and the flow path constituting portion 4 are same members, a similar effect can be obtained even when the nozzle plate 8 and the flow path constituting portion 4 are different members.

First Exemplary Embodiment

Figure 3A:
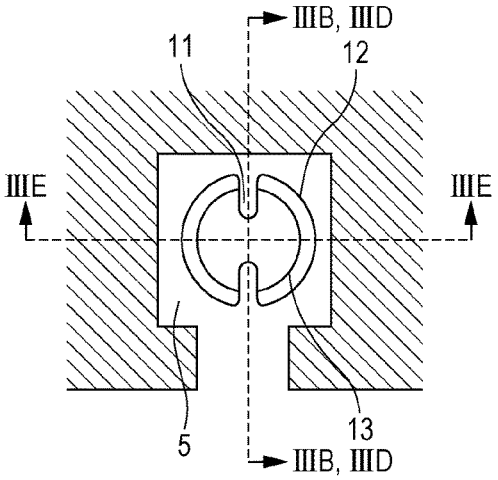
FIGS. 3A to 3E are drawings illustrating a configuration of the liquid ejection head of the first exemplary embodiment.
Figure 3B:
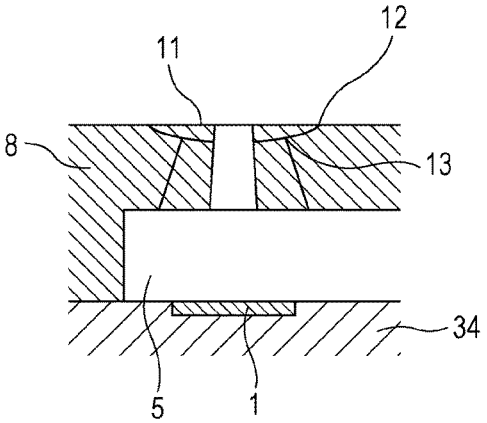
Figure 3C:
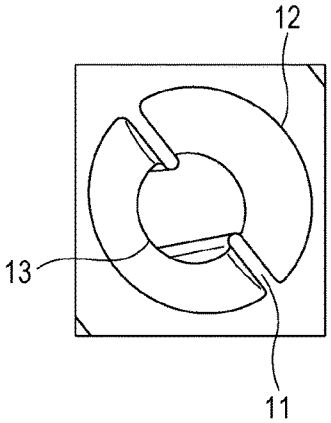
Figure 3D:
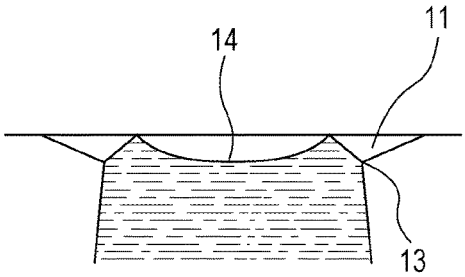
Figure 3E:
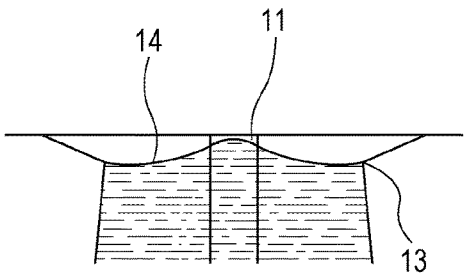

An exemplary embodiment to which the present disclosure can be applied will be described below. FIG. 3A illustrates a front view of the nozzle plate including protrusions of the present disclosure, and FIG. 3B illustrates a section cut along line IIIB-IIIB in FIG. 3A. FIG. 3C is a perspective view of the ejection port. FIG. 3D illustrates a meniscus formed when the liquid is filled, and illustrates a section of the vicinity of the ejection port taken along line IIID-IIID in FIG. 3A. FIG. 3E illustrates a meniscus formed when the liquid is filled, and illustrates a section of the vicinity of the ejection port taken along line IIIE-IIIE in FIG. 3A. As a comparative example, a configuration of an election port including protrusions is illustrated in FIGS. 4A to 4E in a similar manner to that of FIGS. 3A to 3E.

In the election port including the protrusions illustrated in FIG. 3A, a first opening portion (a first ejection port) formed of two protrusions 11 opposing each other and a round-shaped ejection port outer edge portion 12 is formed in the outer surface of the nozzle plate 8. Furthermore, a round-shaped outer edge portion 13 of a second opening portion (a second ejection port) is formed inside the ejection port outer edge portion 12. Recessed portions are provided in the outer surface of the nozzle plate 8, and the first ejection ports 12 are positioned on an outer surface side of the recessed portions, and the second ejection ports 13 are positioned on a bottom surface side of the recessed portions. The two opening portions share the protrusions, and the positions and the areas of the round-shaped outer edge portions of the two opening portions are different. As illustrated in the cross-sectional view in FIG. 3B, a depressed portion (a recessed portion) is formed in a direction extending from the first opening outer edge portion 12 towards the bubble forming chamber 5, and the second opening portion is formed in the depressed portion (the recessed portion). The round-shaped outer edge portion 13 of the second opening portion has an area (a diameter) that is smaller than that of the round-shaped outer edge portion 12 formed in the surface of the nozzle plate S. Furthermore, as illustrated in FIG. 3B, an election port portion that connects the bubble forming chamber 5 and the ejection port to each other has a tapered shape. As described above, the flow resistance of the ejection port portion can be made small by having the opening diameter of the ejection port portion on the pressure chamber side be smaller than the opening diameter of the ejection port portion on the ejection port side.

The ejection ports including the protrusions of the present disclosure each have a so-called tapered shape, in which the diameter of the round-shaped outer edge portion 13 becomes larger from the second opening portion (on the outer surface side of the nozzle plate) towards the bubble forming chambers 5 side, and the protrusions, compared with the shape of the ejection port, have a straight shape. The protrusions 11 opposing each other function to suppress formation of micro droplets, in other words, satellite droplets or mist, formed during ejection, and the separation between the discharged droplet trailing end portion and the meniscus is performed between the protrusions that oppose each other. FIG. 3C illustrates a perspective view of the ejection port. A distance between distal ends of the protrusions 11 is smaller than the opening diameter of the second ejection port 13. As described above, the protrusions 11 are provided from the ejection port outer edge portion 12 towards a center portion of the ejection port, more preferably, towards the center, the surfaces of the protrusions 11 are at a position similar to that of the nozzle plate, and the protrusions 11 project to the nozzle plate surface side with respect to the ejection port outer edge portion 13. As illustrated in the drawing, the distance between the portions of the tip portions of the plurality of protrusions 11 on the outer surface side and the substrate 34 is larger than the distance between the outer edge portions of the second ejection ports 13 and the substrate 34. From another aspect, the plurality of protrusions 11 extend along the outer surface of the nozzle plate 8 from the outer edge portion of the first ejection port 12 towards the center portion of the second ejection port 13.

A position where the meniscus is formed when the liquid is filled in the liquid ejection head will be illustrated in FIGS. 3D and 3E. FIG. 3D illustrates a state of the meniscus in a cross-section taken along line IIID-IIID in FIG. 3A. While the meniscus is formed at the round-shaped ejection port outer edge portion 13 formed in the depressed portions, the meniscus 14 at the protrusions 11 is lifted in the ejection direction at the side wall portions of the distal ends of the protrusions 11 due to surface tension so as to be elevated (protruded) along circumferential side walls of the distal ends of the protrusions 11. FIG. 3E illustrates the meniscus taken along line IIIE-IIIE in FIG. 3A. In FIG. 3E, similar to the above, the meniscus 14 is elevated in the election direction at the side walls around the protrusions. The elevated amount of the meniscus is dependent on contact angles between the side wall portions of the protrusions 11 and the liquid, and as the contact angles between the side walls and the liquid become small and as the side walls become wet more easily, the meniscus becomes more elevated.

Figure 4A:
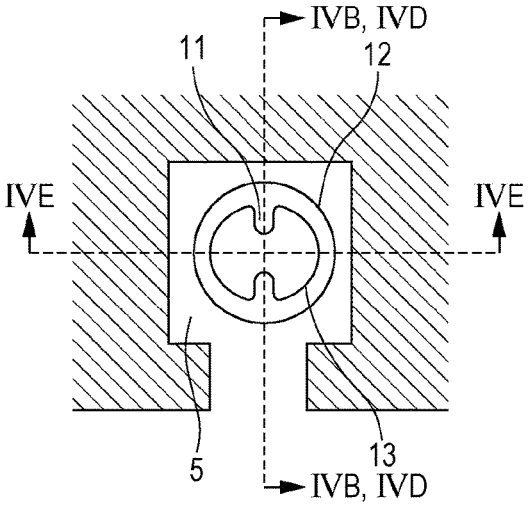
FIGS. 4A to 4E are drawings illustrating a configuration of a liquid ejection head of a comparative example.
Figure 4B:
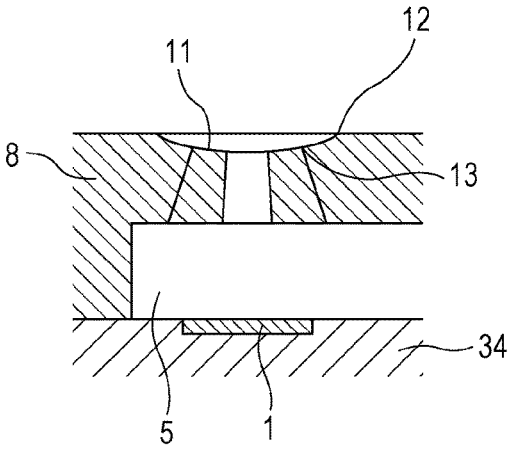
Figure 4C:
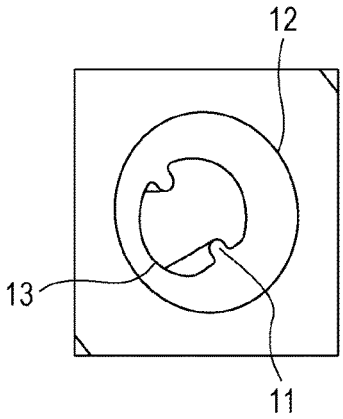

A comparative example of an ejection port including protrusions, comparative with respect to the above, is illustrated in FIGS. 4A to 4E. A basic performance of the ejection ports including the protrusions is similar to that of the ejection ports including the protrusions illustrated in FIGS. 3A to 3E. FIG. 4A illustrates a front view of the conventional ejection port including protrusions viewed from the front side of the nozzle plate, and FIG. 4B illustrates a section cut along line IVB-IVB in FIG. 4A. FIG. 4C is a perspective view of the ejection port.

Figure 4D:
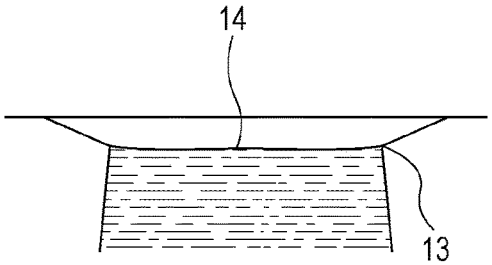
Figure 4E:
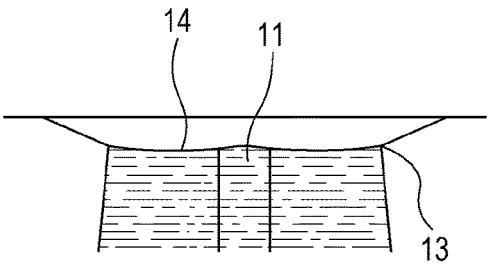

FIG. 4D illustrates a meniscus formed when the liquid is filled, and illustrates a section of the vicinity of the ejection port taken along line IVD-IVD in FIG. 4A. FIG. 4E illustrates the meniscus formed when the liquid is filled, and illustrates a section of the vicinity of the election port taken along line IVE-IVE in FIG. 4A. As illustrated in FIG. 4A, an outer edge portion 12 of a first opening formed in a surface of a nozzle plate 8 has a round shape. Furthermore, protrusions 11 and an outer edge portion 13 formed in a round shape are formed as a second opening inside the outer edge portion 12. Accordingly, the ejection port is structured so that the first opening portion does not have any protrusions, and the second opening portions alone are provided with the protrusions.

Referring next to the cross-sectional view in FIG. 4B, as described above, edge surfaces of the protrusions 11 are at a similar position as that of the second opening portion and are formed at a depressed position with respect to the surface of the nozzle plate 8, in other words, at a position in the vicinity of a bubble forming chamber 5. FIG. 4C is a perspective view of the ejection port. The first opening outer edge portion 12 is in the surface of the nozzle plate, and has a round shape with no protrusion. The second opening outer edge portion 13 is formed in the depressed portion and the protrusions 11 are provided therein. Accordingly, as illustrated in FIGS. 4D and 4E, when an ejection liquid is filled in the liquid ejection head, the meniscus 14 of the liquid is formed at the outer edge portion 13 of the second opening portion, which is a position similar to that of the edge surfaces of the protrusions 11.

Figure 5A:
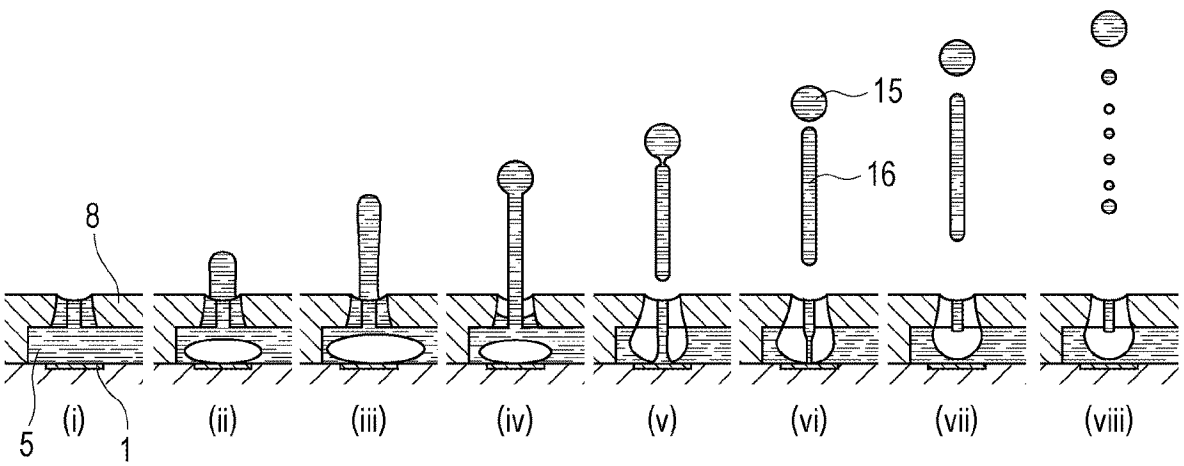
FIG. 5A is an ejection process drawing of the liquid ejection head of the comparative example and FIG. 5B is that of the first exemplary embodiment.
Figure 5B:
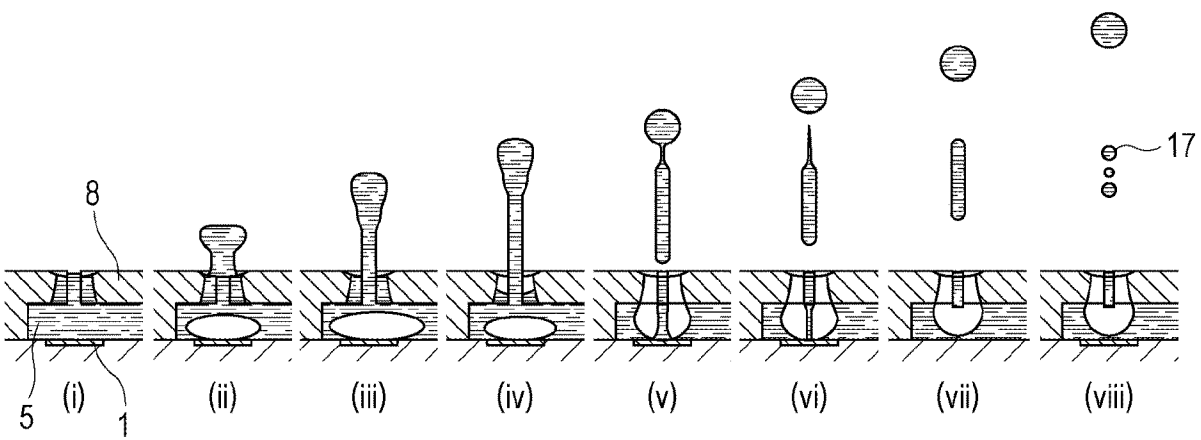

An ejection process of the ejection ports of the present disclosure will be described next. FIG. 5A is an ejection process drawing of the comparative example, and FIG. 5B is an ejection process drawing of the ejection port including the protrusions of the present disclosure. Step (i) in FIG. 5A illustrates a state immediately before the ejection operation, and the meniscus is formed along the ejection port outer edge portion in the depressed portion. From the above state, in step (ii), bubbling through film boiling of the ejection liquid is started by applying an electric signal to the electrothermal transducer element 1, and with the above, the ejection operation is started. In step (iii), the size of the bubble formed by bubbling becomes the largest and, subsequently, in step (iv) and after, the bubble formed by film boiling enters a debubbling operation. In step (iv), since the meniscus is drawn in in the direction of the bubble forming chamber with the debubbling operation, ink resides between the protrusions. The debubbling operation is completed in step (v). The meniscus is drawn inside the bubble forming chamber, and the discharged droplet trailing end portion and the protrusions are separated from each other; accordingly, the ejection operation is completed. In steps (vi) to (viii), the ejected liquid is separated into a main droplet portion 15 and a liquid column portion 16 during the election and, subsequently, the liquid column portion 16 is separated into a plurality of sub-droplets, which become the satellite droplets or the mist.

An ejection process of the present disclosure in FIG. 5B will be described next. Step (i) illustrates a state immediately before the ejection operation, and as described above, the meniscus around the protrusions is elevated in the election direction with respect to the meniscus formed on the ejection port outer edge portion in the depressed portion. From the above state, in step (ii), bubbling through film boiling of the ejection liquid is started by applying an electric signal to the electrothermal transducer element 1, and with the above, the ejection operation is started. In the above step, an increase in the liquid volume at the tip portion of the ejection liquid caused by the liquid in the elevated meniscus portion in step (i) can be seen. In steps (iii) and (iv) as well, the effect of the liquid in the elevated meniscus portion on a connecting portion between a portion that forms the main droplet portion and a portion that forms the liquid column continues to be exerted, and in step (v), the connecting portion turns into a long and thin liquid column. In step (vi), the main droplet portion and the liquid column portion become separated from each other and, as illustrated in step (vii), the tip portion of the liquid column portion that has become thin is then taken into the liquid column, and when taken in, the speed of the liquid column tip portion is decreased. In step (viii), the liquid column becomes short due to the deceleration effect of the liquid column tip portion and is separated, subsequently, into a plurality of sub-droplets; accordingly, the amount of satellite droplets or the mist that is formed is small. Furthermore, due to the deceleration effect of the liquid column tip portion, an ejecting speed of a sub-droplet 17 that is the closest droplet to the main droplet is slower than the speed of the other sub-droplets, and the sub-droplets collide against each other and becomes united during the ejection; accordingly, formation of satellite droplets and mist is suppressed.

Second Exemplary Embodiment

Figure 6:
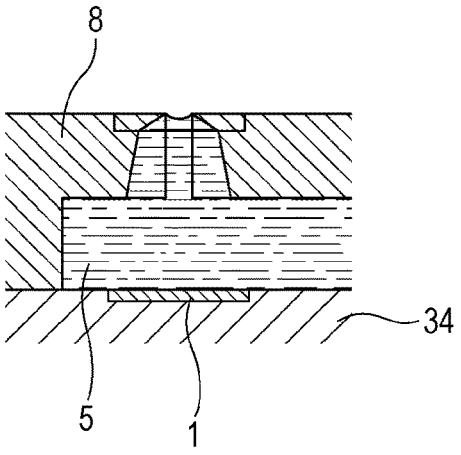
FIG. 6 is a cross-sectional view of an ejection portion of a liquid ejection head of a second exemplary embodiment.

A second exemplary embodiment of the present disclosure is illustrated in FIG. 6. Note that since the basic function and the ejection operation of the ejection ports are similar to those of the first exemplary embodiment, points that are different will be described. While the depressed portions (the recessed portions) of the first exemplary embodiment each have a bowl shape having a curved surface, in the present exemplary embodiment, the depressed portions each have a rectangular shape. In other words, the depressed portions are each formed of a flat surface having a bent portion. Even if the depressed portions are rectangular, a similar effect can be obtained by the effect of the election operation described above as long as the meniscus position on the side walls of the protrusions is elevated with respect to the meniscus position on the ejection port outer edge portion in the ejection direction.

Third Exemplary Embodiment

Figure 7A:
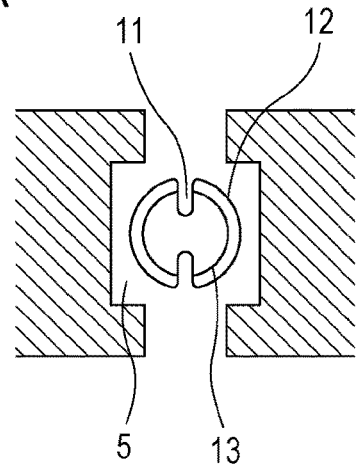
FIGS. 7A and 7B are schematic drawings of a liquid ejection head of a third exemplary embodiment.
Figure 7B:
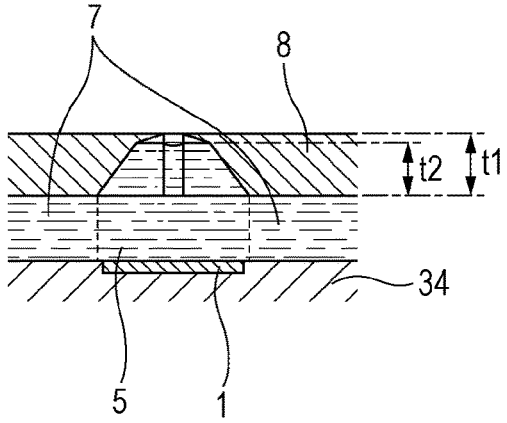

A third exemplary embodiment of the present disclosure is illustrated in FIGS. 7A and 7B. Referring to FIG. 7A, in order to agitate the ink inside the ejection ports by circulation and to suppress increase in viscosity, generally, a thickness (t1 in FIG. 7B) of the nozzle plate 8 is better the smaller. The above is because if the nozzle plate 8 is thick, even if the ink is circulated, a flow of ink flowing to the vicinity of the surface of the nozzle plate 8 inside the ejection port is not created; accordingly, the viscosity of the ink at the above portion continues to be high. However, on the other hand, if the nozzle plate 8 is formed thin, the plate strength becomes low, and a crack may be formed or the nozzle plate 8 may become broken. Furthermore, since a thickness (same as t1 in FIG. 7B) of the protrusions of the ejection ports including the protrusions becomes thinner as the nozzle plate becomes thinner, the effect exerted by the ejection ports including the protrusions of suppressing the satellite droplets or the mist may become decreased.

Conversely, when the present disclosure is applied, as illustrated in FIGS. 7A and 7B, the thickness of the nozzle plate can be made small only in the vicinity of the ejection port (t2 in FIG. 7B) by adjusting the depth of the depressed portion. Furthermore, since the ejection port has a tapered shape, the ejection port has a structure that can facilitate the flow of the liquid flowing in the liquid flow path 7 to be drawn into the ejection port. With the above, the effect of agitating the liquid inside the ejection port can be increased while keeping the thickness of the nozzle plate 8 at a set thickness or more and maintaining the strength of the plate to a set strength or higher. Furthermore, even if the depressed portion is made deep (even if t2 in FIG. 7B is set small), since the thickness of the protrusion 11 can be obtained independent of the depth of the depressed portion, the effect of suppressing the mist of the ejection port including the protrusions can be obtained.

As described above, by applying the ejection port of the present disclosure to a liquid ejection head that includes liquid flow paths on both sides of each bubble forming chamber 5, the ejection function and performance can be improved while maintaining structural reliability.

Method of Manufacturing Liquid Ejection Head

Figure 8A:
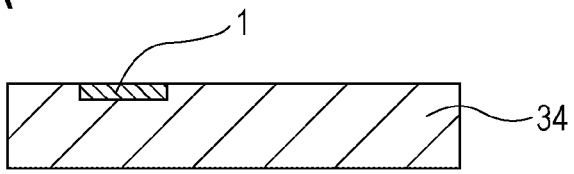
FIGS. 8A to 8H are drawings illustrating a method of manufacturing the liquid ejection head of the first exemplary embodiment.
Figure 8B:
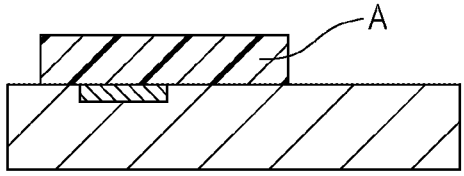
Figure 8C:
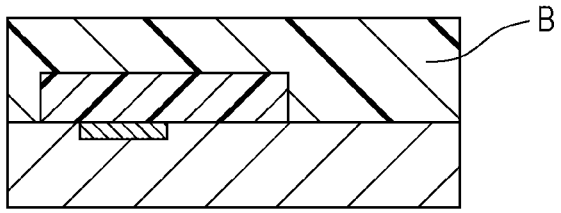

A method of manufacturing the liquid ejection head of the first exemplary embodiment will be described with reference to FIGS. 8A to 8H. As illustrated in FIG. 8A, first, the substrate 34 in which the electrothermal transducer element 1 that generates energy to eject the liquid is prepared. In FIG. 8B, a photosensitive resin A that is to become the pattern of the liquid flow path 7 is applied onto the substrate 34 and is exposed and developed so as to perform patterning of the liquid flow path 7. Subsequently, in FIG. 8C, a photosensitive resin B that is to become the flow path wall and the nozzle plate is applied so as to cover the liquid flow path 7.

Figure 8D:
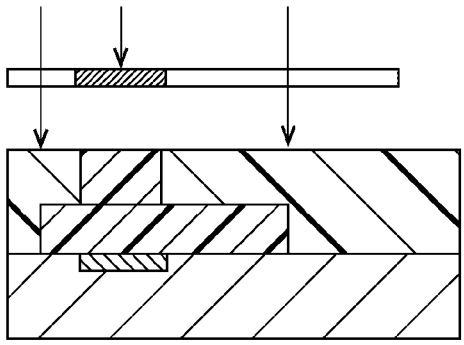
Figure 8E:
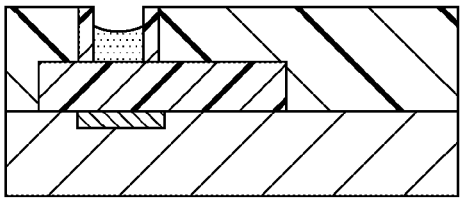

In order to form a recess in the photosensitive resin layer B, exposure is performed through a mask interposed in between so that the recessed portion is the non-exposed portion (FIG. 8D). In other words, exposure is performed on the nozzle plate, the ejection port outer edge portion on the nozzle plate, and the protrusions 11. Subsequently, by performing heat treatment (post exposure bake) at a temperature at or higher than the softening point temperature of the photosensitive resin layer B, curing of the photosensitive resin layer B proceeds at the non-exposed portion and the resin shrinks (FIG. 8E). With the above, the nozzle plate, the ejection port outer edge portion on the nozzle plate, and the protrusions 11 described above are formed.

Figure 8F:
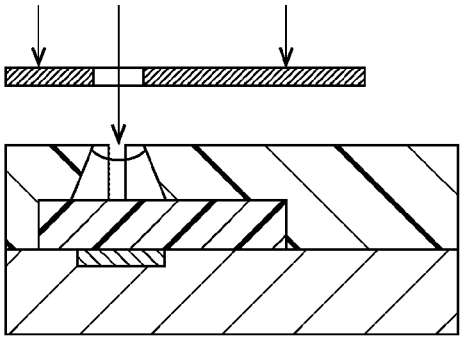

Furthermore, the non-exposed portion of the photosensitive resin B is heated to the softening point or higher, and with the curing and shrinking of the non-exposed portion, a recess that has a volume equivalent to the reduced volume is formed. Furthermore, the ejection port is obtained inside the recessed portion by patterning through exposure and development of the round-shaped ejection port in the recessed portion that has been formed (FIG. 8F). In the above, due to the difference in the refractive index of light, the recessed shape acts as a lens at the interface between the air and the recessed portion during the exposure, and light is refracted. Since the angle of refraction is determined by the angle of inclination of the recessed portion, the ejection port outer edge portion is formed into a tapered shape due to the large refraction of light.

Figure 8G:
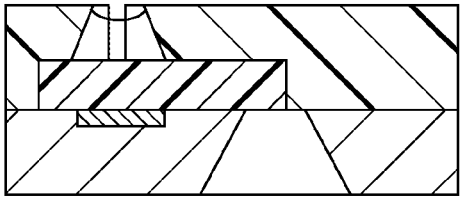
Figure 8H:
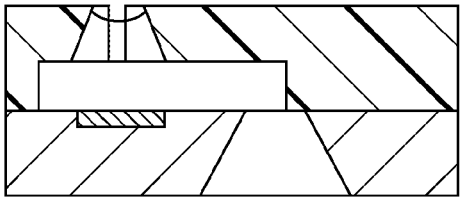

Subsequently, as illustrated in FIG. 8G, the ink supply port 3 is formed from the side opposite the flow path forming side of the substrate 34 by using an anisotropic etching technology that uses the difference in etching speed owing to the crystal orientation of silicon. Lastly, as illustrated in FIG. 8H, the photosensitive resin A at the portion where the flow path is to be formed is melted with a solvent and the melted portion becomes the flow path; accordingly, the head is fabricated.

In the manufacturing method of the present exemplary embodiment, since the focus position during the exposition forming the election port is close to the ejection port, an ejection port with high size accuracy can be formed. Furthermore, the diameter of the recessed shape can be changed with the mask, and the depth of the recess can be controlled by the exposure dose, the temperature and time of the heat treatment. Accordingly, adjustments can made as appropriate according to the size of the formed ejection port including the protrusions.

Figure 9A:
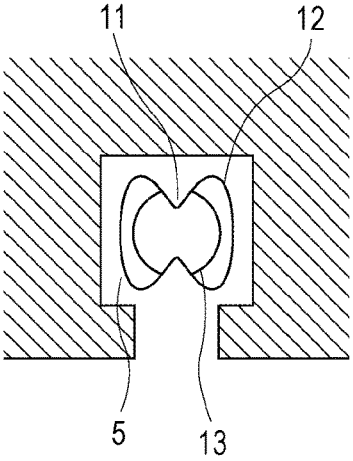
FIGS. 9A to 9C are drawings illustrating other examples of the shapes of the ejection ports.
Figure 9B:
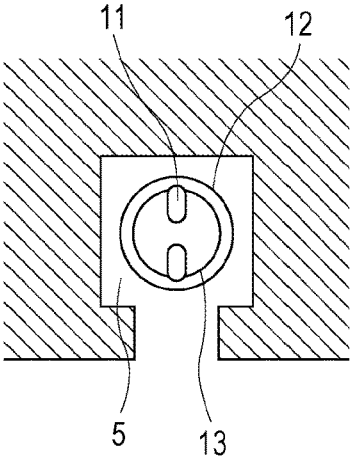
Figure 9C:
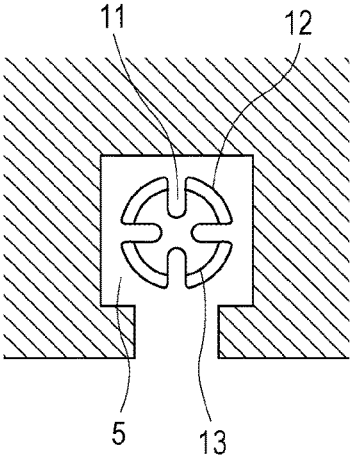

While the shape, the function, and the method of manufacturing the ejection port of the present disclosure have been described above, the ejection port including the protrusions of the present disclosure can be applied to ejection port shapes other than the ejection port shape described above. The present disclosure can be applied to a liquid ejection head having an ejection port shaped so that the protrusions are oriented in the center direction, or any ejection port having a similar structure and, for example, can be applied to election port shapes illustrated in FIGS. 9A to 9C.

The present disclosure is capable of, while reducing the resistance in the ejection port portion, suppressing formation of satellite droplets accompanying the main droplet.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-104161 filed May 26, 2017, which is hereby incorporated by reference herein in its entirety.

What is claimed is:

1. A liquid ejection head comprising:

a substrate provided with an element that generates energy used to eject a liquid; and a nozzle plate including an ejection port that ejects the liquid, wherein the ejection port includes, a first ejection port that is an opening portion formed on an outer surface side of a recessed portion formed in an outer surface of the nozzle plate, a second ejection port positioned on a bottom surface side of the recessed portion, the second ejection port including an opening portion that is smaller than the first ejection port, and a plurality of protrusions that extend from an outer edge portion of the first ejection port towards a center portion of the second ejection port through the second ejection port, and wherein a distance between a portion on the outer surface side at a tip portion on a center side of the protrusion and the substrate is larger than a distance between an outer edge portion on the outer surface side of the second ejection port and the substrate.

2. The liquid ejection head according to claim 1, wherein the plurality of protrusions are provided at positions that oppose a center of the second ejection port.

3. The liquid ejection head according to claim 2, wherein a distance between distal ends of the plurality of protrusions is smaller than an opening diameter of the second ejection port.

4. The liquid ejection head according to claim 1, wherein the first ejection port and the second ejection port are connected to each other with a curved surface.

5. The liquid ejection head according to claim 1, wherein the first ejection port and the second ejection port are connected to each other with a flat surface including a bent portion.

6. The liquid ejection head according to claim 1, further comprising:

a pressure chamber, inside of which the element is provided; and an ejection port portion that connects the pressure chamber and the second ejection port to each other.

7. The liquid ejection head according to claim 6, wherein an opening diameter of the ejection port portion on a pressure chamber side is larger than an opening diameter on a second ejection port side.

8. The liquid ejection head according to claim 6, wherein tip portions of the plurality of protrusions extend from an outer surface side of the nozzle plate towards a pressure chamber side.

9. The liquid ejection head according to claim 8, wherein a distance between distal ends of the plurality of protrusions on the pressure chamber side is smaller than an opening diameter of the ejection port portion on the pressure chamber side.

10. The liquid ejection head according to claim 1, wherein the first ejection port and the second ejection port are connected to each other with a curved surface.

11. The liquid ejection head according to claim 1, further comprising:

a pressure chamber inside of which the element is provided; and an ejection port portion that connects the pressure chamber and the second ejection port to each other.

12. The liquid ejection head according to claim 11, wherein an opening diameter of the ejection port portion on a pressure chamber side is larger than an opening diameter on a second ejection port side.

13. The liquid ejection head according to claim 11, wherein tip portions of the plurality of protrusions extend from an outer surface side of the nozzle plate towards a pressure chamber side.

14. The liquid ejection head according to claim 13, wherein a distance between distal ends of the plurality of protrusions on the pressure chamber side is smaller than an opening diameter of the ejection port portion on the pressure chamber side.

15. A liquid ejection head comprising:

a substrate provided with an element that generates energy used to eject a liquid; and a nozzle plate including an ejection port that ejects the liquid, wherein the ejection port includes, a first ejection port that is an opening portion formed on an outer surface side of a recessed portion formed in an outer surface of the nozzle plate, a second ejection port positioned on a bottom surface side of the recessed portion, the second ejection port including an opening portion that is smaller than the first ejection port, and a plurality of protrusions that extend from an outer edge portion of the first ejection port towards a center portion of the second ejection port through the second ejection port, and wherein in a state in which the liquid is filled in the liquid ejection head, a meniscus of the liquid is formed on an outer edge portion on the outer surface side of the second ejection port, in which the meniscus at a portion on the outer surface side on a center side of the protrusion, with respect to the outer edge portion of the second ejection port, in an ejection direction in which the liquid is ejected.

* * * * *